US005412961A

United States Patent [19]

Cain et al.

[11] Patent Number: 5,412,961

[45] Date of Patent: May 9, 1995

[54] EXIT DELAYING MECHANISM FOR PANIC EXIT DOOR

[75] Inventors: Michael L. Cain, Noblesville; Marlin D. Austin, Speedway, both of Ind.

[73] Assignee: Von Duprin, Inc., Indianapolis, Ind.

[21] Appl. No.: 70,064

[22] Filed: Jun. 1, 1993

[51] Int. Cl.[6] ..... E05C 15/02

[52] U.S. Cl. ..... 70/92; 292/92

[58] Field of Search ..... 70/92; 292/92, 21

[56] References Cited

U.S. PATENT DOCUMENTS

| | | | |
|---|---|---|---|
| 4,624,490 | 11/1986 | Miller | 70/92 |
| 4,785,286 | 11/1988 | Martin | 292/92 |
| 4,801,163 | 1/1989 | Miller | 292/92 |
| 4,968,070 | 11/1990 | Choi | 292/92 |
| 5,011,199 | 4/1991 | Lowe et al. | 292/92 |
| 5,035,450 | 7/1991 | Muller | 292/92 |
| 5,085,475 | 2/1992 | Austin et al. | 292/92 |
| 5,169,185 | 12/1992 | Slaybaugh et al. | 292/21 |

*Primary Examiner*—Peter M. Cuomo
*Assistant Examiner*—Monica E. Millner
*Attorney, Agent, or Firm*—Robert F. Palermo; A. James Richardson

[57] ABSTRACT

A mechanism for dogging a door latch assembly of a panic exit device having a retractible door latch biased to move outward from the door latch assembly, with inward movement of the door latch being activated by a push bar, includes a mechanism for holding a key cylinder positioned adjacent to the door latch assembly. A catch mechanism linked to the door latch is configured to move as the door latch is retracted, and a arm is pivotably mounted adjacent to the key cylinder holding mechanism. The arm is configured to retain the catch mechanism, with the door latch being prevented from outwardly moving with respect to the door latch assembly. When a key cylinder having an attached sweep arm is rotated, the sweep arm can alternatively rotate to engage the catch mechanism when a key is turned in the key cylinder, dogging the door latch assembly, or undog the catch mechanism from the arm by sweeping around to break the attachment between the arm and catch mechanism, allowing the door latch to move from its retracted position to its normally biased outward position with respect to the door latch assembly.

9 Claims, 4 Drawing Sheets

EXIT DELAYING MECHANISM FOR PANIC EXIT DOOR

BACKGROUND OF THE INVENTION

The present invention relates to door hardware for controlling disengagement of a door lock mechanism and more particularly to panic exit devices that permit easy opening of a door by movement of a push bar.

Building codes for publicly accessible structures typically require provision of marked emergency exits secured by a push bar activated emergency latch mechanism. This allows occupants of a structure to exit quickly and easily in an emergency. However, for many types of facilities it is not desirable to allow ready escape from the facility in non-emergency situations. One solution is to provide an alarm that activates whenever the door of an emergency exit is opened. As an improvement, the door itself can remain closed for a set period of time, typically five to fifteen seconds, as the alarm is sounded. This brief delay allows time for security personnel to detain an individual attempting to exit in a non-emergency situation, while still allowing easy exit in an emergency. Such exit delaying mechanisms are particularly useful for retail stores, schools, hospital, or nursing care facilities that need to control public access while still allowing escape in emergency situations.

One known mechanism for providing for a delay is described in U.S. Pat. No. 5,011,199, with inventors Lowe et al, and assigned to Von Duprin, Inc., the disclosure of which is hereby incorporated by reference. U.S. Pat. No. 5,011,199 describes a commercially available device that has a time delayed mechanism for obstructing movement of a latch bolt from a latched position to an unlatched position. Manual actuation of a push pad pivots an arm connected to a linkage. Movement of the linkage incidentally activates a time delay circuit component, which in turn controls interruption of electrical power to a solenoid. When powered, the electromagnetic attraction of the solenoid prevents movement of a bar/rod combination away from a position that effectively blocks full pivotable movement of the arm, preventing unlatching the door. After the preset time delay elapses (during which time visual or auditory alarms triggered by the attempt to open the emergency door are active) the electrical power to the solenoid is interrupted, allowing movement of the bar/rod combination away from their arm blocking position, and retraction of the latch bolt.

Another mechanism for ensuring a time delayed emergency exit is described in U.S. Pat. No. 5,085,475 to Austin et al., assigned to Von Duprin, Inc, the disclosure of which is hereby incorporated by reference. Like the device described in U.S. Pat. No. 5,011,199, the door exit delay mechanism described in Austin includes an electromagnetic solenoid and a movable limb having a lobe that obstructs pivoting movement of an arm connected to a latch. Inactivation of the solenoid, after a suitable time delay, allows displacement of the movable limb from the arm blocking lobe on the movable limb, permitting retraction of the latch and escape through the door exit.

Although reliable, exit delay mechanisms such as described in U.S. Pat. Nos. 5,011,199 or 5,085,475 can be inappropriate for certain circumstances. Such devices will generally activate an alarm and engage the time delay circuitry when the door is opened, even when the alarm and time delay are not needed or desired. This situation commonly arises for schools and hospitals, which may wish to allow free exit during normal hours, while allowing only emergency exit after hours. It would therefore be desirable to provide an exit delay system that can be selectively deactivated to allow unhindered exit within certain defined time periods, while still allowing simple conversion back to a full exit delaying, alarm activating system. It would also be desirable to provide a keyed lock system attachable to the door to allow engagment or disengagment of the exit delaying system. Such a key controlled exit delaying system advantageously allows simple control of each emergency exit, and selective disengagment of exit delay systems in non-critical areas of buildings. A mechanism for dogging controlled exit devices such as described in U.S. Pat. No. 5,085,475 to Austin et al., assigned to Von Duprin, Inc., or in U.S. Pat. No. 5,011,199, to Lowe et al, and also assigned to Von Duprin, Inc., by holding back operation of the latch bolt of the exit devices, would also be desirable.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a mechanism for dogging a door latch assembly of a panic exit device having a retractable door latch biased to move outward from the door latch assembly, with inward movement of the door latch being activated by a push bar, such a mechanism including a structure for holding a key cylinder positioned adjacent to the door latch assembly; a catch mechanism linked to the door latch, with the catch mechanism being configured to move as the door latch is retracted; an arm pivotably mounted adjacent to the key cylinder holding structure, the arm being configured to retain the catch mechanism, with the door latch being prevented from outwardly moving with respect to the door latch assembly; a key cylinder having an attached sweep arm mounted in the key cylinder holding structure, the sweep arm being configured to alternatively rotate the arm to engage the catch mechanism when a key is turned in the key cylinder, thereby dogging the door latch assembly, or to undog the catch mechanism from the arm by sweeping around to break the attachment between the arm and catch mechanism, thus allowing the door latch to move from its retracted position to its normally biased outward position with respect to the door latch assembly.

The foregoing and other aspects will become apparent from the following detailed description of the invention when considered in conjunction with the accompanying drawing figures.

DETAILED DESCRIPTION

Figure 1:
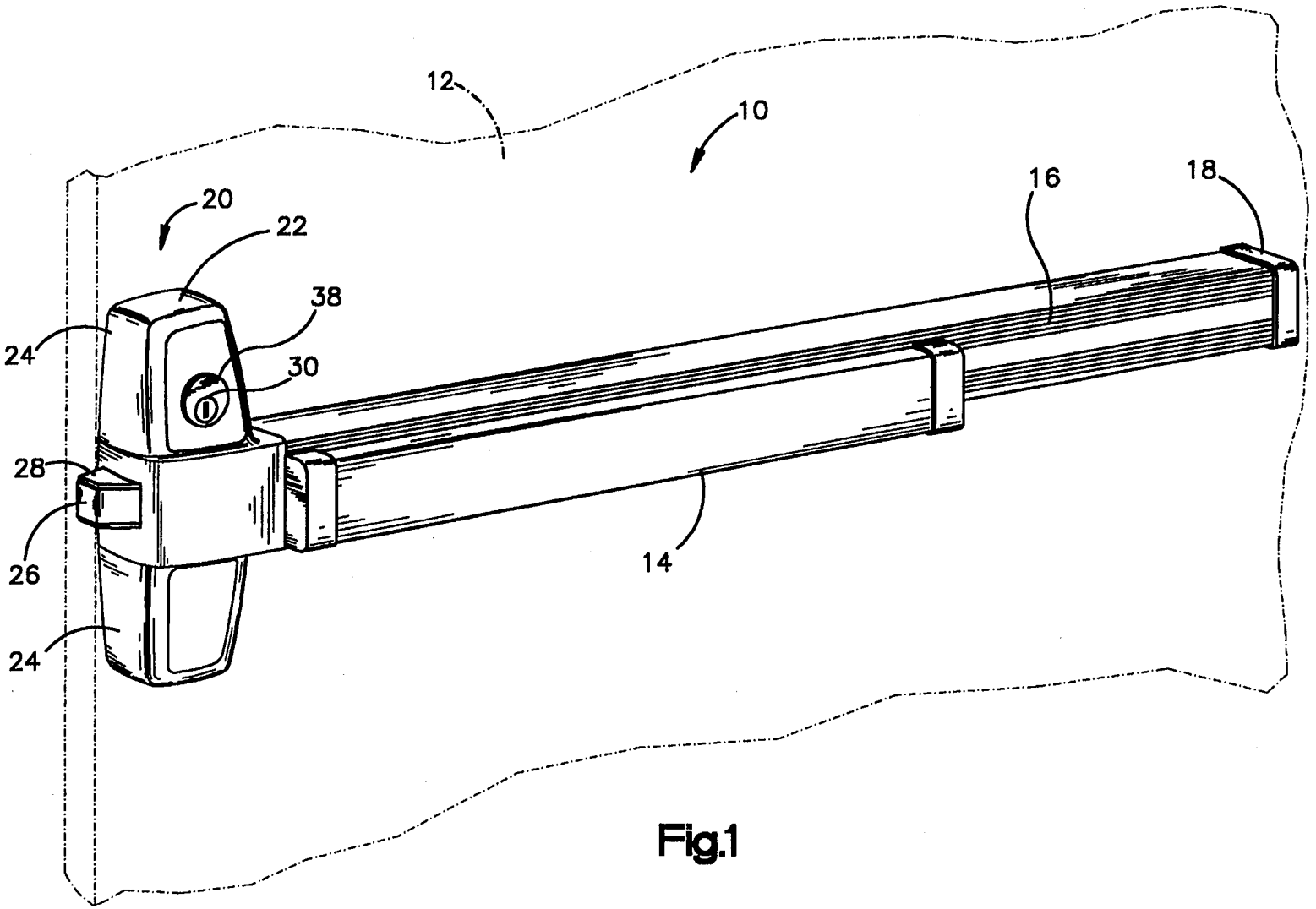
FIG. 1 is a perspective view of a panic exit device doggable by a keyed cylinder mechanism insertable into the panic exit device to inactivate a normally operational time delay and alarm that would be activated when a pushpad of the panic exit device is pushed.

As illustrated in FIG. 1, a panic exit assembly 10 is attached to a door 12. The panic exit assembly 10 includes a push bar 14 operably connected to a door latch assembly 20 by a mechanism concealed within retraction mechanism housing 16 and end cap 18. In normal operation, pushing the push bar 14 toward the door 12 initially triggers an alarm that allows security personnel to determine if opening the door is a result of a genuine emergency. After a predetermined time delay of ten to twenty seconds, the door latch assembly 20 is enabled to release a door latch 26, and allow opening of the door outward for emergency exit.

As those skilled in the art will appreciate, various push bar or push pad designs, time delays, and attachment or positioning variations can be employed in constructing a panic exit device. For purposes of the present invention, emergency exit delaying devices such as described in Austin et al., U.S. Pat. No. 5,085,475 are particularly suitable.

Figure 2:
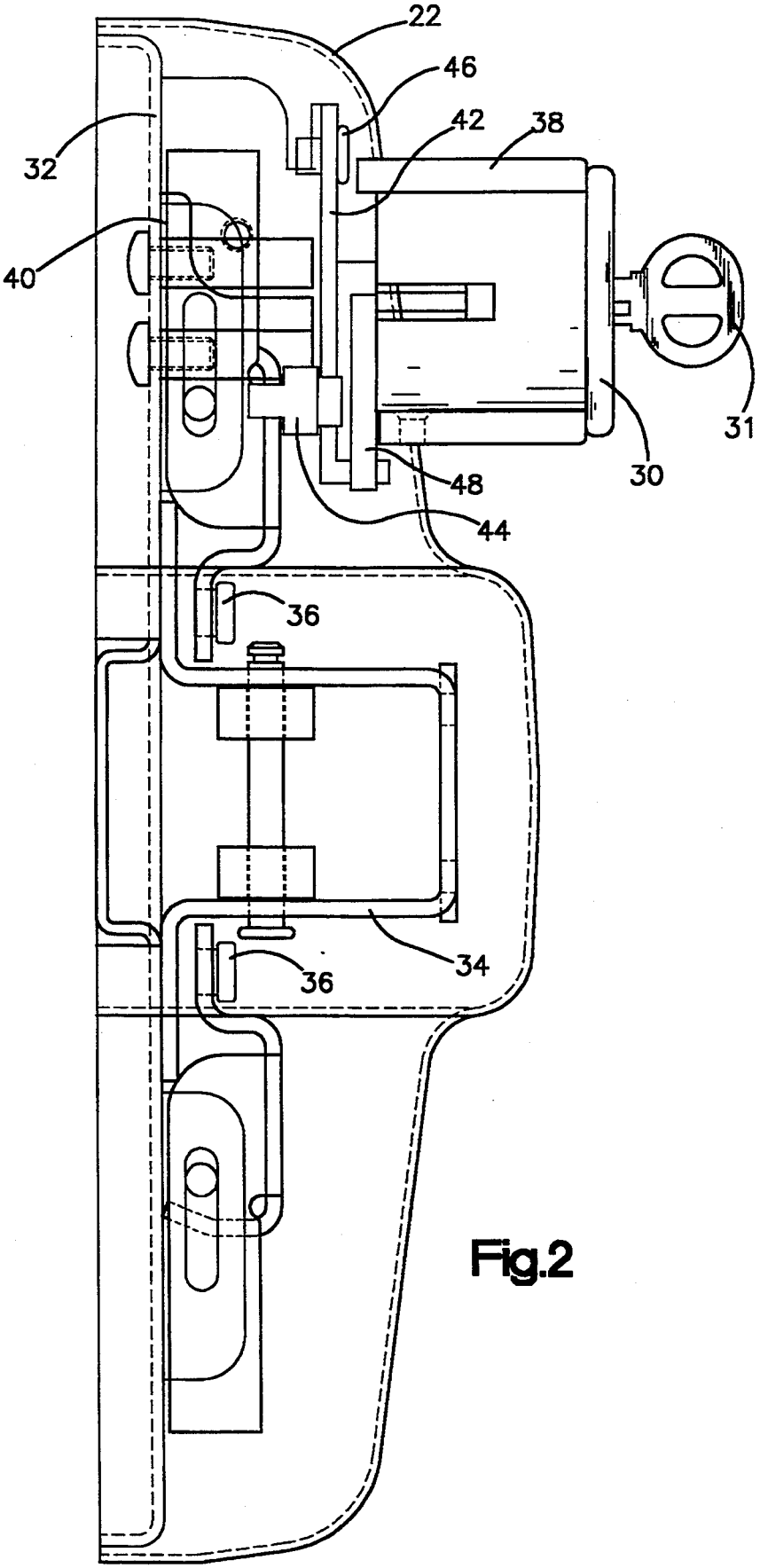
FIG. 2 is a sectional view taken along line 2—2 of the housing and the panic exit device shown in FIG. 1, illustrating positioning of a cylinder lock.

Because it is not always desirable to continually have a panic exit type door trigger an alarm, a mechanism for "dogging" or deactivating the latching mechanism and alarms is provided. As best seen in FIGS. 1 and 2, the dogging mechanism includes a cylinder housing 38 positioned above the door latch 26 in a latch cover 22 of the door latch assembly 20. The latch cover 22 is secured by screws 24 to a frame 32 of the door latch assembly 20 (best seen in FIG. 2).

Figure 3:
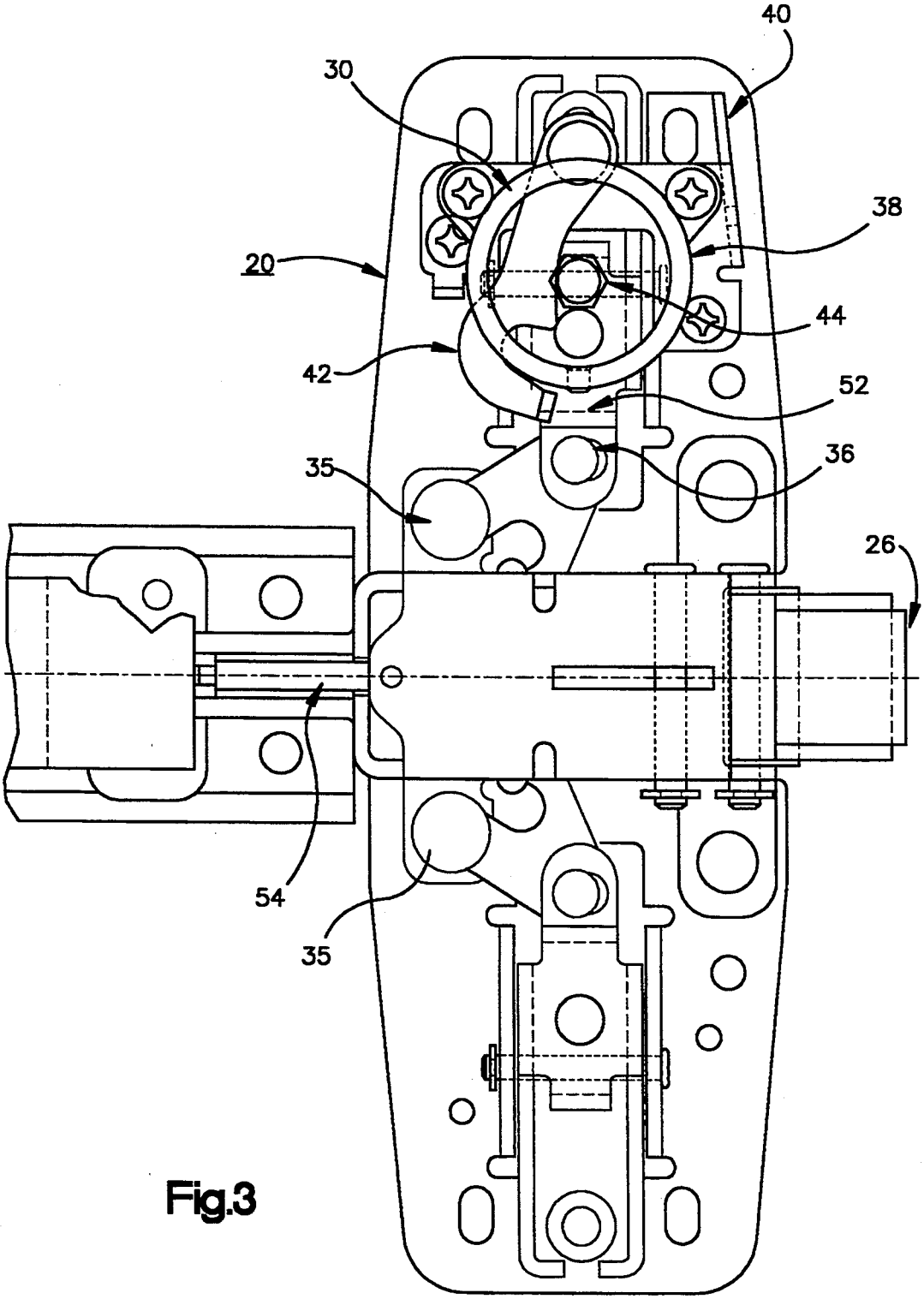
FIG. 3 is an elevation view, partially cut away, having phantom lines to indicate position of components of the panic exit device shown in FIG. 2.
Figure 4:
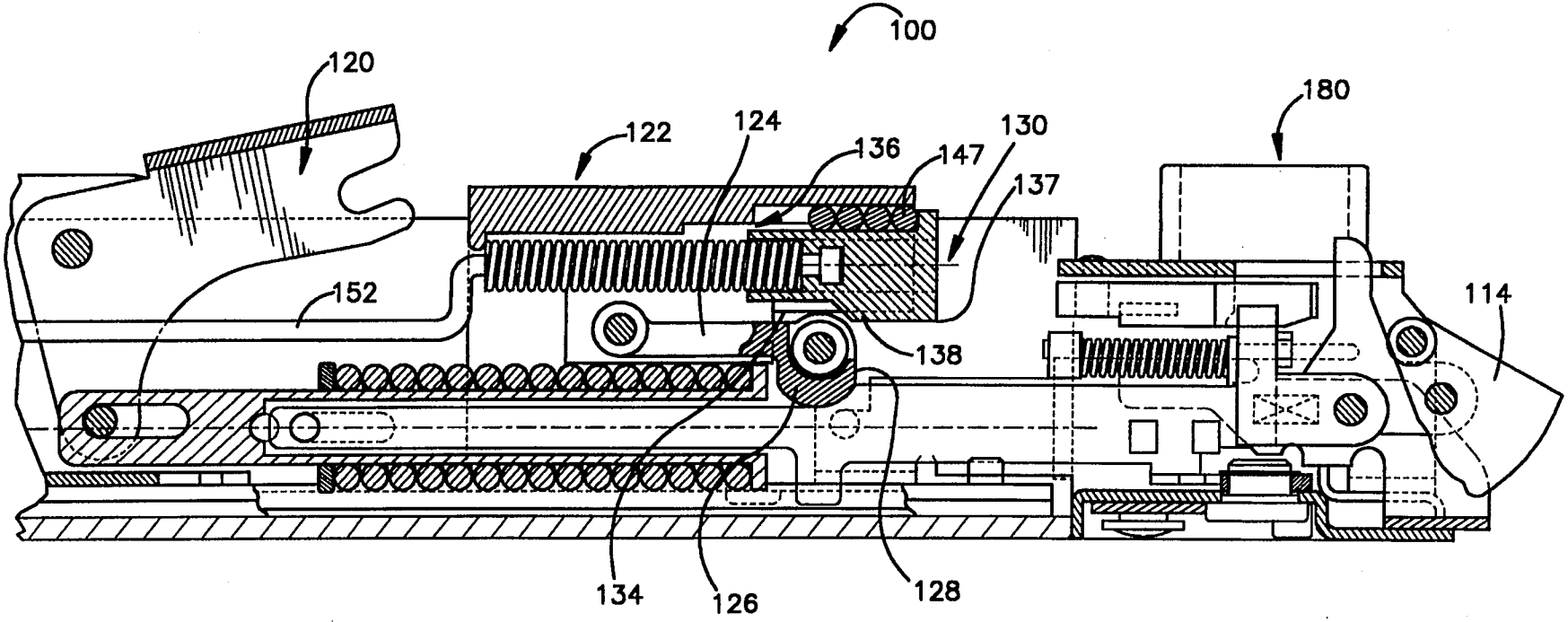
FIG. 4 illustrates alternative placement of a key cylinder, and also provides a detailed view of a solenoid assembly useful for controlling operation of the latch assembly of the present invention, illustrating interconnection of the door latch/solenoid assembly.

As best seen in FIGS. 3 and 4, the panic exit assembly 10 is opened using a delay mechanism substantially as described in connection with Austin et al., U.S. Pat. No. 5,085,475. The push bar 14 is connected by linkage mechanisms to a bar 54. The bar 54 is in turn connected to the door latch assembly 20 by intermediate linkages 34 subject to control by a electrically operated solenoid assembly. Operation of the solenoid assembly is substantially similar to that described in U.S. Pat. No. 5,085,475, and includes a bar inductively movable in a solenoid (not illustrated) coupled to a remote end of rod 152 to control operation of the door latch assembly.

As illustrated in FIG. 4, a latch blocking mechanism includes a housing 122 fixed adjacent to the latch assembly. A first arm 120 is pivotably journalled in housing 122, and a limb 130 is translatable in the housing 122. A trackway 136 is formed in the housing 122, and the limb 130 is configured to have parallel situated rails 138 formed thereon to slidably engage the trackway 136. In addition, rolling elements such as ball bearings 142 are interposed between limb 130 and the housing 122 to facilitate low friction translational movement of the limb 130 through the housing 122.

The limb 130 surmounts the arm 124, presenting an underslung lobe 132 for blocking pivotable movement of the arm 124 and providing a recess 134 for accommodating pivotable movement of the arm 124 when the lobe 132 is moved out of blocking position. Switching between the blocking and unblocked position is controlled by position of the rod 152 and a coupled iron bar (not shown), the movement of which in turn is electrically controlled by activation of the solenoid of which the iron bar is a part.

Operation of the door latch assembly, including the blocking lobes, rod, pushpad operation, etc., can be inactivated by use of a key cylinder 30 having a rotatably attached sweep arm 48. Inactivation is often desirable to prevent excessive wear on the complex solenoid and latch assembly previously described. As illustrated in FIGS. 1, 2, and 3, the key cylinder 30 is removably secured by set screw 39 within the cylinder housing 38. Removably attaching the key cylinder 30 allows easy replacement of the key cylinder when necessary. Turning a key 31 (as seen in FIG. 2) causes rotation of the sweep arm 48, which in turn can alternatively promote engagement or disengagement of a retaining or hook arm 42 and a catch 44.

The hook arm 42 is attached at one end to the frame 32 by a hook arm rivet 46 that allows arcuate movement of the hook arm 42. Since the hook arm 42 is engagable by the sweep arm 48, turning the key 31 causes movement of the hook arm between a vertical position capable of engaging the catch 44, and a position off the vertical axis which allows release of the catch 44.

The catch 44 is moved into position for engagement with the hook arm 42 by pressing the push bar 14 toward the door. After a brief delay during which an alarm sounds and the door push pad cannot be further depressed, the solenoid controlled link 34 is deactivated, enabling movement of a bar 54 connected to the push bar. As the bar 54 is moved to retract the door latch 26, a bell crank 50, and its connected retainer 52 move downward, toward the door latch. When the door latch 26 is completely retracted, the key 31 can be turned to cause the sweep arm 48 to push the hook arm 42 into position above the catch 44. So long as the hook arm 42 is in this position, the catch 44 cannot move upward, as it must to allow extension of the door latch. Accordingly, the panic exit assembly 10 is dogged in an open position until the key cylinder 30 and attached sweep arm 48 is rotated to move the hook arm 42 out of its the blocking position.

Alternative positioning of a key cylinder and its attached sweep arm for dogging is contemplated by the present invention. For example, as illustrated in FIG. 4, a panic exit device 100 configured substantially as described in U.S. Pat. 5,085,475, the disclosure of which is herein incorporated by reference, can optionally be equipped with a key cylinder 180 and its attached sweep arm for dogging action. Similar to the embodiment of the invention discussed with reference to FIGS. 1–3, the embodiment illustrated in FIG. 4 has a doggable latch 114 that overrides pushpad operation (pushpad, not shown, is connected by crank 120 and intermediary links to latch 114). As the key cylinder 180 is rotated, a sweep arm secured within the cylinder housing 38 is rotated to hook a doggable catch. Again, security is enhanced by provision of removable attachment of the key cylinder 180.

While the present invention has been described in connection with specific embodiments, it will be apparent to those skilled in the art that various changes may be made therein without departing from the spirit or scope of the invention.

What is claimed is:

1. A mechanism for dogging a door latch assembly of a panic exit device having a retractable door latch biased to move outward from the door latch assembly, with inward movement of the door latch being activated by a push bar, the mechanism comprising:

means for removably holding a key cylinder positioned adjacent to the door latch assembly, a catch mechanism linked to the door latch, the catch mechanism being configured to move as the door latch is retracted, a retaining arm pivotably mounted adjacent to but separate from the key cylinder holding means, the arm being configured to retain the catch mechanism so that the door latch is prevented from outwardly moving with respect to the door latch assembly, and a key cylinder having an attached sweep arm removably mounted in the key cylinder holding means, the sweep arm being configured alternatively to pivot the retaining arm to engage the catch mechanism when a key is turned in the key cylinder, dogging the door latch assembly, and to disengage the catch mechanism from the arm by sweeping around to break the attachment between the arm and catch mechanism, allowing the door latch to move from its retracted position to its normally biased outward position with respect to the door latch assembly.

2. The assembly of claim 1, wherein the retaining arm for engaging the catch mechanism is configured to present a hook-shape.

3. The assembly of claim 1, wherein the catch mechanism is linked to the door latch to move downwardly toward the door latch as the door latch is retracted, and the retaining arm is configured to pivot into position to block upward movement of the catch mechanism away from the door latch, preventing extension outward of the linked door latch to effectively dog the door latch assembly in an open position.

4. A mechanism for dogging a door latch assembly of a panic exit device having a retractable door latch biased to move outward from the door latch assembly, the mechanism comprising:

a catch mechanism linked to the door latch, the catch mechanism being configured to move as the door latch is retracted, a retaining arm pivotably mounted to the door latch assembly to engage the catch mechanism so that the door latch is prevented from outwardly moving with respect to the door latch assembly when the arm is engaged with the catch mechanism, a key cylinder holding means situated at a position spaced from the retaining arm for holding a key cylinder, and a key cylinder removably held by the key cylinder holding means and a sweep arm fixed to the key cylinder and configured alternatively to pivot the retaining arm to engage the catch mechanism and dog the door latch assembly, and to sweep the catch mechanism from the arm to disengage the attachment between the arm and catch mechanism, allowing the door latch to move from its retracted position to its normally biased outward position with respect to the door latch assembly.

5. The assembly of claim 4, wherein the retaining arm is pivotably mounted to move in an arc, the arm being configured to engage the catch mechanism when vertically oriented, and to disengage from the catch mechanism when swept from a vertical orientation.

6. The assembly of claim 5, wherein the retaining arm further comprises a hook-shaped extension to guide the catch mechanism into engagement with the retaining arm as the retaining arm is pivoted through an arc into a vertical orientation.

7. The assembly of claim 4 wherein the sweep arm fixed to the key cylinder and the catch mechanism are both positioned above the door latch.

8. The assembly of claim 7 wherein the catch mechanism is linked to the door latch to move downwardly toward the door latch as the door latch is retracted, and the retaining arm is configured to rotate into position to block upward movement of the catch mechanism away from the door latch, preventing extension outward of the linked door latch to effectively dog the door latch assembly in an open position.

9. A doggable panic exit assembly comprising: a frame, a door latch mounted to said frame for movement relative to said frame between a latched position and an unlatched position, and a manually-actuated linkage joined to said door latch and mounted to said frame for promoting movement of said door latch from said latched position to said unlatched position, said panic exit assembly further comprising:

a catch mechanism linked to the door latch, the catch mechanism being configured to move as the door latch is retracted, a retaining arm pivotably mounted to the door latch assembly to engage the catch mechanism so that the door latch is prevented from outwardly moving with respect to the door latch assembly when the retaining arm is engaged with the catch mechanism, and a user controlled sweep arm positioned for sweeping in an arc remotely from the retaining arm and configured alternatively to move the retaining arm to engage the catch mechanism and dog the door latch assembly, and to disengage the catch mechanism from the arm by sweeping in an arc to break the attachment between the arm and catch mechanism, allowing the door latch to move from its retracted position to its normally biased outward position with respect to the door latch assembly.

* * * * *